United States Patent [19]

Ueda

[11] Patent Number: 4,599,503

[45] Date of Patent: Jul. 8, 1986

[54] MICROWAVE OVEN HAVING LOW-ENERGY DEFROST AND HIGH-ENERGY COOKING MODES

[75] Inventor: Shigeki Ueda, Yamato Kouriyama, Japan

[73] Assignee: Matsushita Electric Industrial Co., Ltd., Japan

[21] Appl. No.: 740,335

[22] Filed: Jun. 3, 1985

[30] Foreign Application Priority Data

Jun. 4, 1984 [JP] Japan ..... 59-114970

[51] Int. Cl.[4] ..... H05B 6/68

[52] U.S. Cl. ..... 219/10.55 B; 219/10.55 M; 219/10.55 R; 219/518; 99/325

[58] Field of Search ..... 219/10.55 B, 10.55 M, 219/10.55 R, 518, 492; 99/325, DIG. 14

[56] References Cited

U.S. PATENT DOCUMENTS

| | | | |
|---|---|---|---|
| 4,097,707 | 6/1978 | Kobayashi et al. | 99/325 X |
| 4,336,433 | 6/1982 | Yokozeki | 219/10.55 B |
| 4,379,964 | 4/1983 | Kanazawa et al. | 219/10.55 B X |
| 4,441,002 | 4/1984 | Teich et al. | 219/10.55 B |
| 4,453,066 | 6/1984 | Mori | 219/10.55 B X |
| 4,481,394 | 11/1984 | Tanabe | 219/10.55 B |
| 4,508,948 | 4/1985 | Carlson | 219/10.55 M |

FOREIGN PATENT DOCUMENTS

| | | |
|---|---|---|
| 0078607 | 5/1983 | European Pat. Off. . |
| 3138025 | 5/1982 | Fed. Rep. of Germany . |
| 2083923 | 3/1982 | United Kingdom . |

*Primary Examiner*—Philip H. Leung

*Attorney, Agent, or Firm*—Lowe, Price, Leblanc, Becker & Shur

[57] ABSTRACT

A microwave oven comprises a weight detector for detecting the weight of a foodstuff to be heated, a condition detector for detecting a substance emitted from the food as a result of heating, and a control unit that responds to the output of the weight detector by setting a defrost time period in which the food is to be defrosted. The microwave energy is set to a low level during the defrost period. Upon the termination of the defrost, the energy is raised to a higher level and continued for a period of time determined as a function of the interval between the instant the defrost mode terminates and the instant the amount of the detected substance reaches a predetermined value.

16 Claims, 13 Drawing Figures

MICROWAVE OVEN HAVING LOW-ENERGY DEFROST AND HIGH-ENERGY COOKING MODES

BACKGROUND OF THE INVENTION

The present invention relates to microwave ovens, and more specifically to an automatic microwave oven in which frozen food is heated in a series of cycles of different energy levels and durations. The invention is particularly useful for defrosting and cooking prepared frozen foods or mixed frozen vegetables in a single operation.

Conventional automatic microwave ovens include a microcomputer and humidity or gas sensors for detecting when the gas or vapor emitted by heated food exceeds a threshold. As a function of the time taken to reach the threshold, the microcomputer estimates a time period in which the heating operation is to be continued and automatically shuts off the microwave power at the end of the estimated period. In such ovens foodstuff is heated at a constant energy level throughout from the onset to the end of operation. Because of the relatively short cooking time, the constant heating may be advantageous for heating frozen foods in a single defrost-cooking mode. Due to the relatively high energy level during defrost cycle, however, this method suffers from localized hot and cold spots. These hot and cold spots are carried over to subsequent cooking cycles. As a result, the natural quality and flavour of the food deteriorate. In the case of prepared frozen foods such as hamburgers, curry and stew, the inner part of the food remains frozen while the outer areas are heated to an appropriate temperature.

SUMMARY OF THE INVENTION

It is therefore an object of the present invention to provide an automatic microwave oven in which frozen food is heated at a low level energy during a defrost cycle over a period determined by the weight of the food and subsequently at a higher level energy during cooking cycle.

The microwave oven of the invention includes a manually operated key for the entry of a command to sequentially operate the oven in defrost and cooking modes, a heating chamber in which an article to be heated is placed, a generator for radiating microwave energy into the chamber for heating the article, a weight detector for detecting the weight of the article, and a condition detector for detecting a substance emitted by the article as a result of heating. A control unit is operable in response to the entry of the command to determine the time period of the defrost mode as a function of the detected weight and causes the energy generator to generate microwave energy of a lower level during the determined period of time and subsequently generate microwave energy of a higher level during a time period which is a function of the interval between the instant at which the time period of the defrost mode terminates and the instant at which the amount of the substance detected by the condition detector reaches a predetermined value.

Defrost mode is divided into two cycles of high and low energy levels. The period of each cycle is determined by the detected weight of the food. The microwave energy is set to a higher level in the initial cycle to rapidly defrost frozen food and reduced in the second cycle to a lower level to allow thermal energies developed in surface areas to diffuse to inner areas. As a result of the thermal diffusion and weight-controlled defrost periods, temperature differences between the outer and inner areas are substantially reduced, so that the food is uniformly defrosted to an optimum condition for it to be subsequently heated at a higher level energy.

BRIEF DESCRIPTION OF THE DRAWINGS

The present invention will be described in further detail with reference to the accompanying drawings, in which.

DETAILED DESCRIPTION

Figure 1:
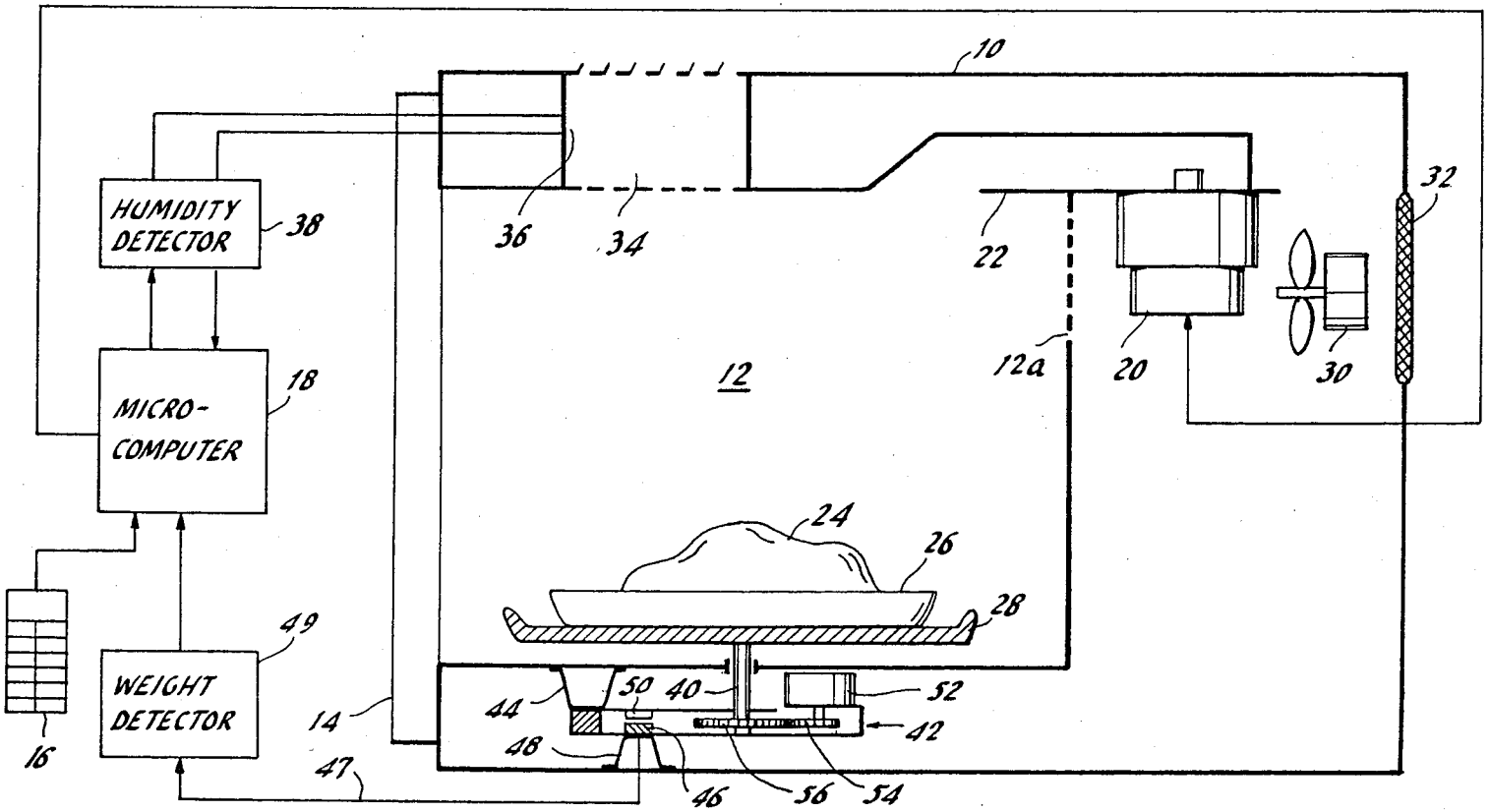
FIG. 1 is a schematic illustration of a microwave oven according to the present invention.

The automatic microwave oven of the invention shown in FIG. 1 comprises a housing 10 having a heating chamber 12 and a door 14 hinged on the front panel. A control panel 16 located on the front of housing 10 includes several pushbuttons to enter a user's commands to a microcomputer 18 and indicator lamps. A high frequency generator, or magnetron 20 is located at the rear of the housing. Microwave power is generated by the magnetron. The average energy level of the heating power is controlled by microcomputer 18 in a manner as will be described. The generated microwave energy is conducted through a duct 22 and radiated into the heating chamber 12 to heat a frozen article 24 with a dish 26 placed on a turntable 28. Rear wall 30 of the heating chamber is formed with small openings 12*a* to admit fresh air into chamber 12 by a fan 30 through a filter 32 on the rear wall of housing 10. An exhaust passage 34 is formed on top of the housing to exhaust gases and water vapor generated by the heated food to the outside. A humidity sensor 36 is located on the wall of exhaust passage 34 to detect when the cooked food is approaching the end of cooking. The humidity sensor 36 is coupled to a humidity detector circuit 38 which is in turn connected to the microcomputer 18.

The turntable 28 has a rotary shaft 40 which is mounted on a weight sensing mechanism 42. One end of the mechanism 42 is secured to a bracket 44 secured to the bottom of heating chamber 12. A coil 46 is stationarily mounted on a support 48 on the bottom of housing 10 in a position opposite to a permanent magnet 50 which is mounted on the weight sensing mechanism 42. Coil 46 is connected by leads 47 to a weight detector circuit 49 which is in turn connected to microcomputer 18. A motor 52 is mounted on the free end of mechanism 42 to drive a gear 54 in mesh with a gear 56 which is coupled to the shaft 40 of turntable 28.

Figure 2:
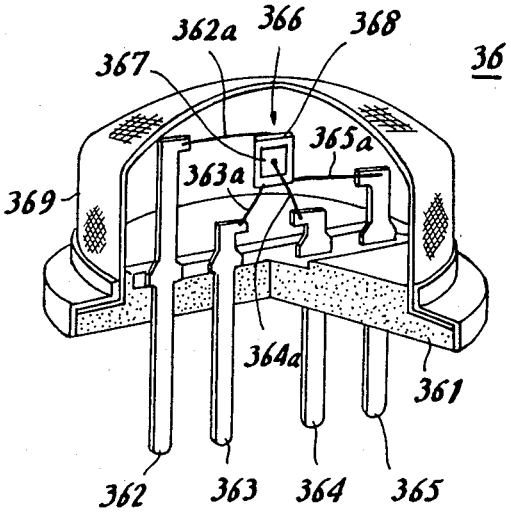
FIG. 2 is a partially cutaway view of the humidity sensor of FIG. 1.
Figure 3:
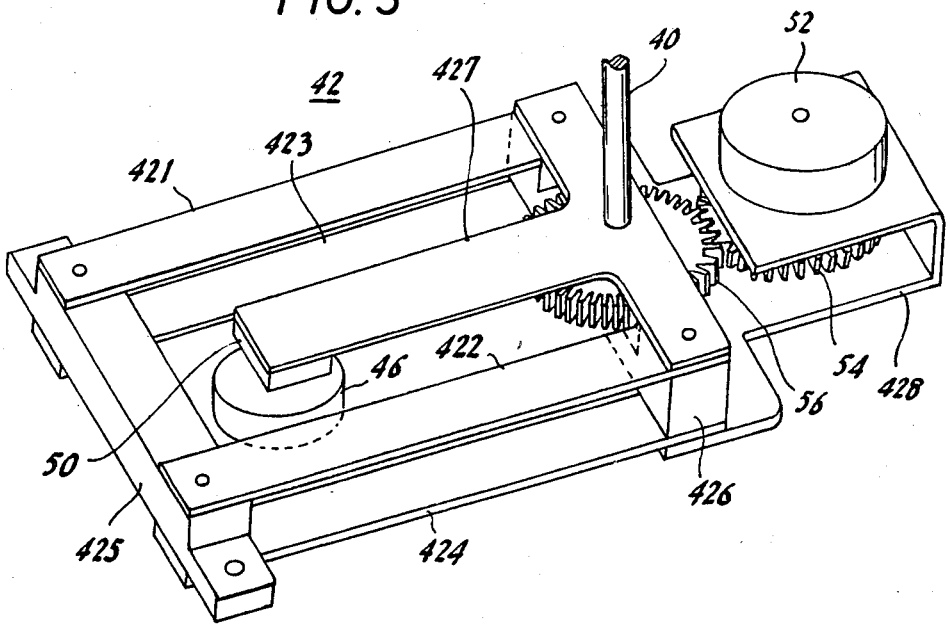
FIG. 3 is a perspective view of the weight sensor of FIG. 1.

Details of the humidity sensor 36 and weight sensor 42 are shown in FIGS. 2 and 3, respectively. In FIG. 2, humidity sensor 36 comprises a ceramic base 361, pins 362 to 365 extending through base 361 and a sensor chip 366 supported by wires 362*a*, 363*a*, 364*a*, and 365*a* connected respectively to the upper ends of pins 362 through 365. Chip 366 comprises an inner, humidity sensing part 367 which is connected by lead wires 364*a*, 365*a* and pins 364, 365 to humidity detector 38 and an outer, heating part 368 which is connected by lead wires 362*a*, 363*a* and pins 362, 363 to humidity detector 38. The sensing part 367 is composed of a ceramic which is a mixture of MgO and $ZrO_2$. This inner part is heated by the outer heating part so that the electrical resistance of the sensing part may vary in accordance with the absolute humidity of the environment. The ceramic base is covered by a metal net 369 to protect the sensor chip and keep it warm by containing heated air therein. The humidity sensor of this type is available under the trademark "Neo-humiceram" from Matshushita Electric Industrial Company, Ltd. Instead of the humidity sensor, a gas sensor composed of $SnO_2$ could also be used. Such gas sensors are available from Figaro Engineering Inc. (Japan).

The weight sensing mechanism 42 comprises a pair of upper metallic members 421 and 422 and a pair of lower metallic members 423 and 424. Upper members 421 and 422 are secured at first ends to a crosspiece 425 and secured at second, opposite ends to a U-shaped crosspiece 426. Crosspiece 425 is connected to the bracket 44, FIG. 1. Lower members 423 and 424 are likewise secured to the crosspieces 425 and 426 at their opposite ends in parallel with the upper members to form a Roberval mechanism. The permanent magnet 50 is fitted to the free end of the limb of a T-shaped member 427 the arms of which are connected to the crosspiece 426 so that the limb of the T runs parallel to the upper and lower members of the weight sensing mechanism. Rotary shaft 40 of the turntable extends through a hole in the T-shaped member 427 to rotatably pivot on the U-shaped crosspiece 426. Gear 56 mounted on shaft 40 is located in the space between T-shaped member 427 and crosspiece 426. Motor 52 is mounted on a bracket 428 which is connected to the crosspiece 426 so that motor 52 and gear 54 move with the weight sensing mechanism. The weight sensing mechanism 42 utilizes the Roberval principle which allows shaft 40 to move precisely in vertical directions (direction of thrust) under the weight of the heated material and to oscillate at a frequency proportional to the weight placement on the turntable, so that weight measurement can be taken accurately independent of the location of food on the turntable 28.

Figure 4:
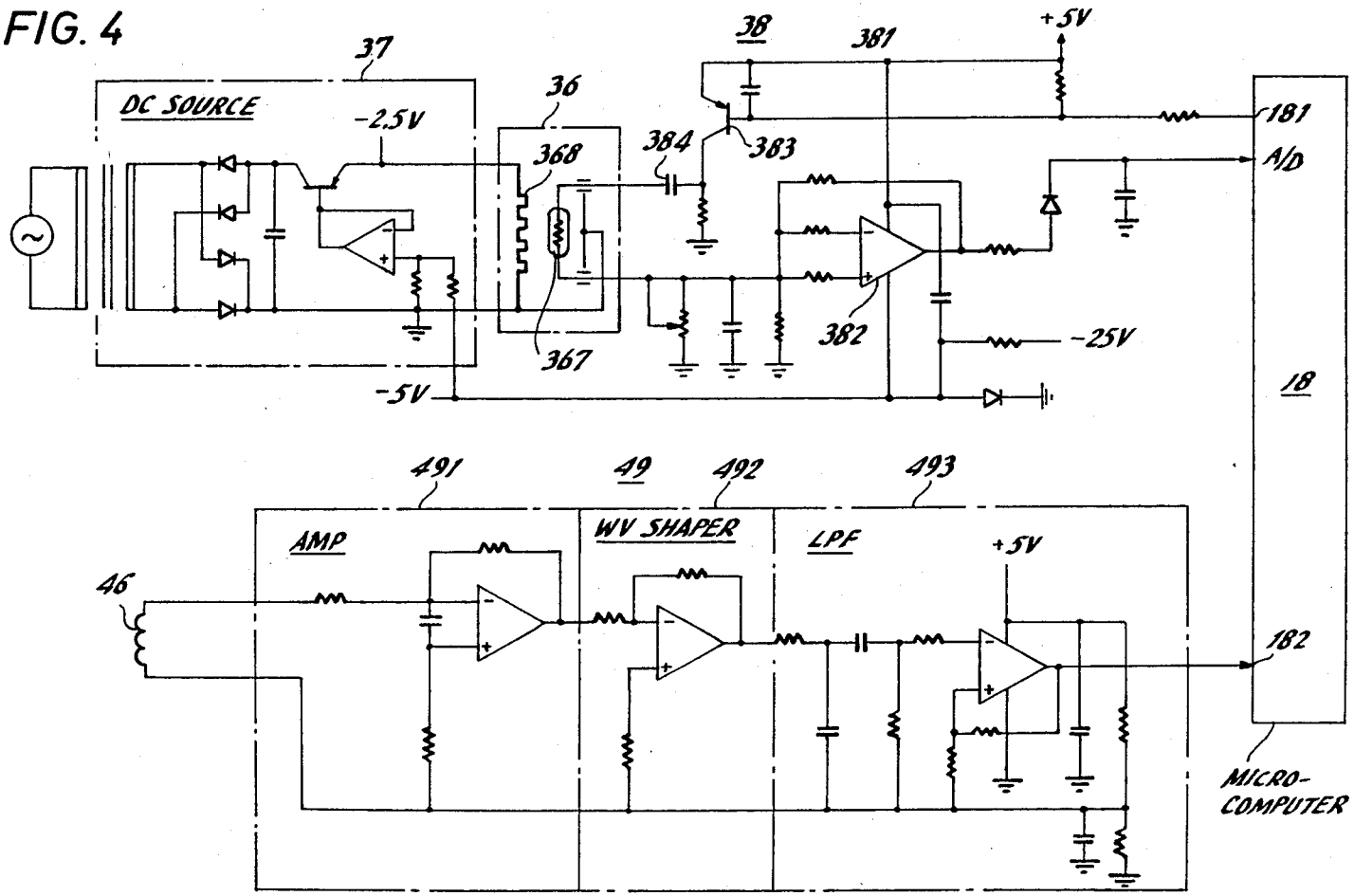
FIG. 4 is a circuit diagram associated with the sensors of FIGS. 2 and 3.

As shown in FIG. 4, the humidity sensor 36 is connected to a DC voltage source 37 to energize its heating element 368 by a stabilized DC voltage. The humidity detector circuit 38 is essentially an amplifier 381 which includes an operational amplifier 382 and a transistor 383. The sensing part 367 of the sensor 36 is connected at one terminal to the noninverting input of operational amplifier 382 and at the other terminal to the collector of transistor 383 via capacitor 384. The base of transistor 383 is connected to a terminal 181 of microcomputer 18 to which it applies a signal to interrogate the humidity sensor 36. The output of operational amplifier 382 is connected to the analog-to-digital conversion terminal A/D of microcomputer 18 to convert the output of sensor 36 into a digital signal when it is interrogated. The weight detector circuit 49 comprises an amplifier 491 connected to the weight sensing coil 46 to amplify the oscillating voltage generated at the instant when a foodstuff is placed on the turntable 28. The amplified voltage is applied to a wave shaping circuit 492 which converts the oscillating voltage into a series of rectangular pulses which are passed through a low-pass filter 493 to an input terminal 182 of microcomputer 18. Microcomputer 18 detects the interval between successive rectangular pulses and hence the total weight of the foodstuff 24 and utensil 26 combined.

Figure 5:
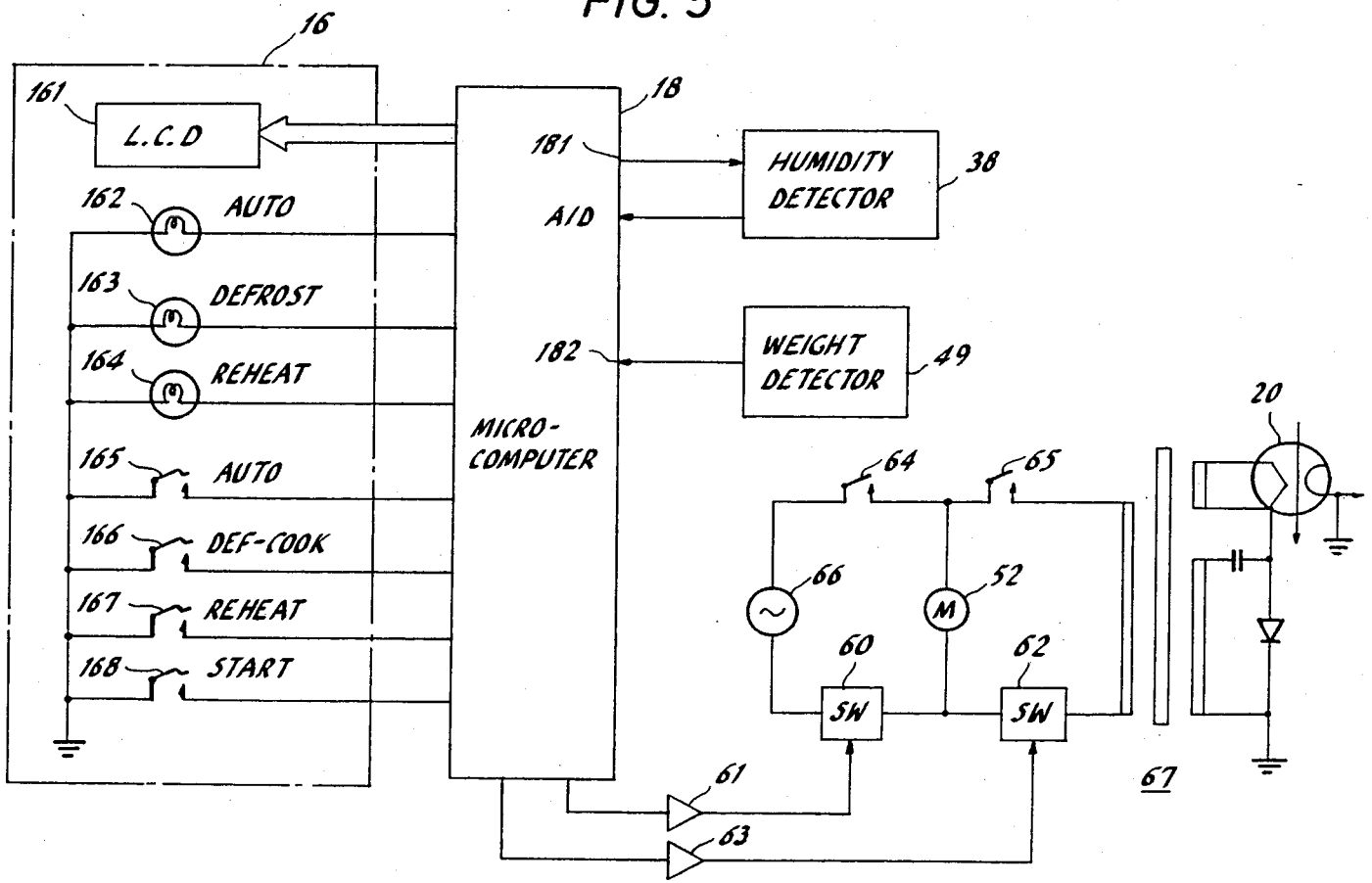
FIG. 5,is a block diagram illustrating details of a portion of FIG. 1.

The control panel 16, shown at FIG. 5, includes a seven-segment liquid crystal display 161, mode indicating lamps 162 to 164 for indicating automatic mode, defrost mode and reheat mode, respectively, and a set of mode select pushbuttons 165 to 167 for setting the apparatus to automatic mode, defrost-cooking mode and reheat mode respectively, and a push-to-start key 168. As will be described later, the combination of defrost and reheat mode lamps indicates different stages of defrost and cooking modes. Microcomputer 18 receives command signals from the pushbuttons operated and delivers outputs to appropriate lamps and liquid crystal display to give visual indications and energizes a power switch 60 via driver 61 and a power interrupt switch 62 via driver 63 in a manner as will be described. Switches 60 and 62 are connected in circuit with door switches 64 and 65 which are closed in response to the closure of the door 14 to apply the AC mains supply from source 66 to the primary winding of a transformer 67. The magnetron 20 is connected to the secondary winding of the transformer 67. The turntable drive motor 52 is connected between the junction of door switches 64 and 65 and the junction of switches 60 and 62.

Figure 6:
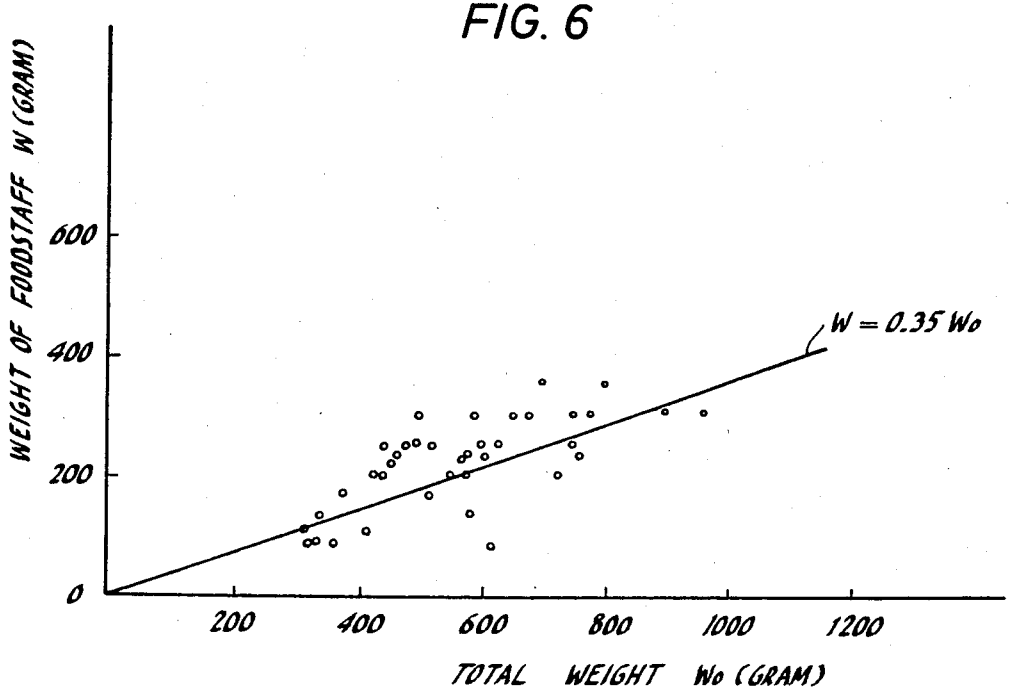
FIG. 6 is a graphic illustration of the correlation between the total weight of foodstuff and utensil and the exclusive weight of the foodstuff.

The microcomputer 18 initially responds to the output of weight detector 49 by setting the duration of defrost mode and setting the microwave energy at a low level. Since the dielectric loss of a frozen food depends exclusively on its mass regardless of its material, the frozen food can be defrosted completely before the operation proceeds to cooking mode. The defrost mode is divided into two succesive cycles defined by time periods $T_1$ and $T_2$ which are given by the following equations:

$$T_1 = K_1 \times Wo \quad (1)$$

$$T_2 = K_2 \times Wo \quad (2)$$

where, $K_1$ and $K_2$ are constants which are determined by factors including the frozen food and utensile, and Wo represents the total weight of the frozen food and utensil. Specifically, $K_1$ is 0.2 and $K_2$ is the ratio of the energy level during defrost cycle $T_1$ to the reduced energy level during defrost cycle $T_2$, this ratio being typically 0.3. During the time period $T_1$ the microwave energy is set to the full power of 600 watts, for example, to provide a rapid defrost cycle and during the period $T_2$ the energy level is reset to one third of the full power. Ideally, the weight of the utensil should be excluded from the total weight. However, this would involve impractically complex procedures. The present invention is based on experimental data that describe the correlation between the total weight and the weight of the frozen food. As illustrated in FIG. 6, the true weight W can be approximated by multiplying a factor of 0.35 on the total value Wo. $T_1$ and $T_2$ can therefore be given by:

$$T_1 = K_1' \times W = K_1' \times 0.35 \times Wo = K_1 \times Wo$$

$$T_2 = K_2' \times W = K_2' \times 0.35 \times Wo = K_2 \times Wo$$

where, $K_1'$ and $K_2'$ are constants determined exclusively by the factor of frozen food.

The frozen food can be uniformly defrosted by successive application of microwave power at high and low energy levels during periods $T_1$ and $T_2$. The succeeding low power defrost cycle is effective to uniformly defrost the food as it allows the initially defrosted, high temperature regions to diffuse to surrounding areas.

The defrost mode is followed by a cooking mode at the termination of the second period $T_2$. During the cooking mode, the microwave power is raised to the full power. This cooking mode is divided into an initial cooking cycle $T_3$ and an additional cooking cycle $T_4$. The cooking cycle $T_3$ starts with the termination of the defrost mode and ends at the instant when the microcomputer responds to the output of the humidity sensor 38 which indicates that cooking operation is approaching the final stage. The additional cooking cycle $T_4$ is determined by the following equation:

$$T_4 = K_3 \times T_3 \quad (3)$$

where, $K_3$ is a constant. However, the cooking cycle $T_3$ tends to vary in a relatively wide range depending on the initial frozen state before the food is placed into the oven, it is preferable to determine $T_4$ in accordance with the following equation:

$$T_4 = K_1(T_1 + K_2 \cdot T_2 + T_3) \quad (4)$$

The variations of the initial frozen state and the use of a disproportionately large utensil for the frozen food may cause it to be excessively heated during the initial defrost cycle. This can be avoided by having the microcomputer examine the output of humidity sensor 38 to detect a prescribed humidity value to switch the heating operation to subsequent low-power defrost cycle.

Figures 7, 7A:
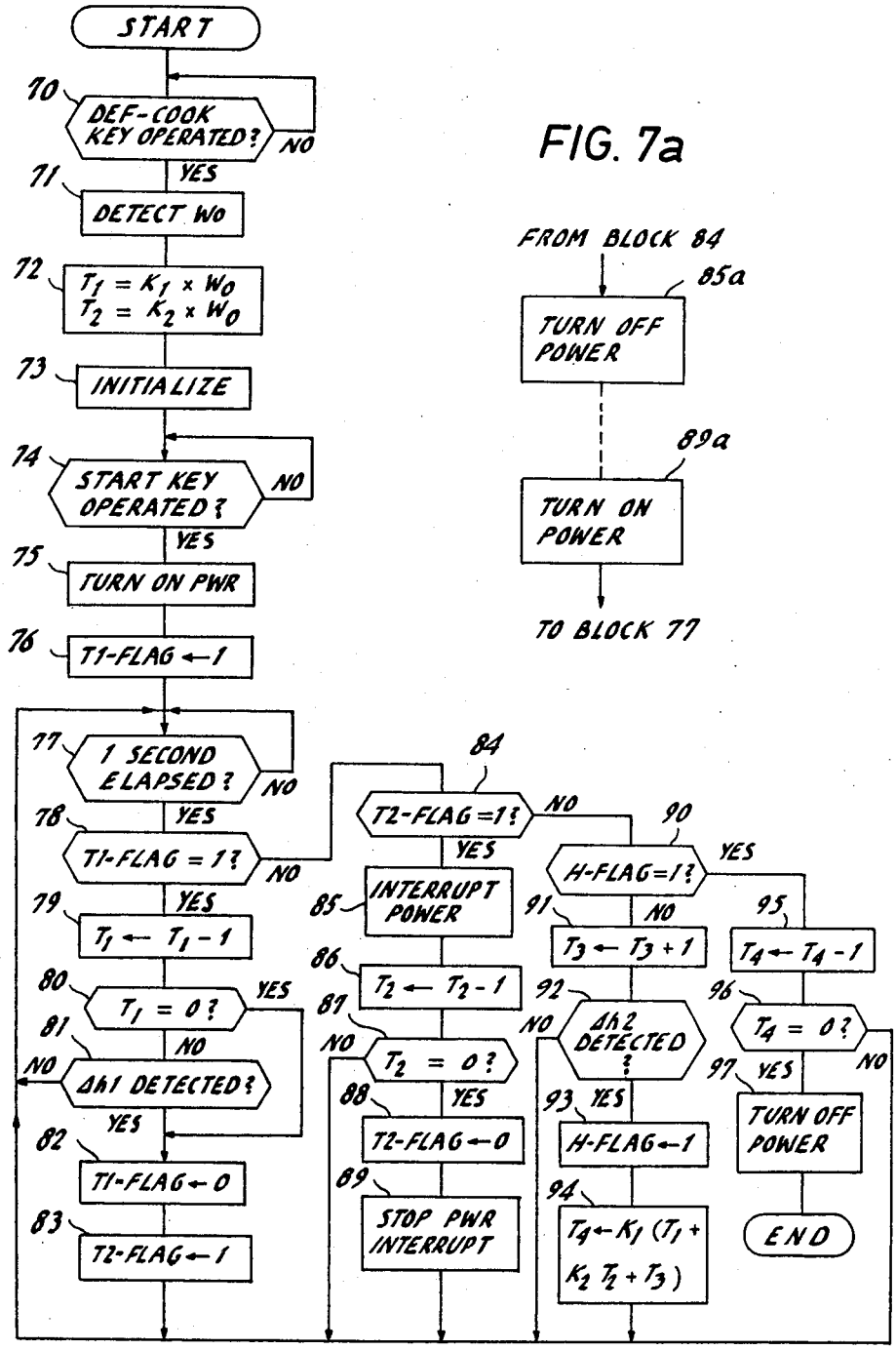
FIG. 7 is a flow diagram associated with the microcomputer of FIG. 1, with FIG. 7*a* illustrating a modification of FIG. 7.

The operation of the microcomputer 18 will be fully understood with a flow diagram shown in FIG. 7.

The continued defrost-cooking mode starts in response to operation of the defrost-cook button 166 and operation of the start key 168 with the automatic mode button 165 being operated.

The program starts with a block 70 where the CPU of microcomputer 18 checks if the defrost-cook key 166 has been operated, and if so control goes to block 71 to detect the total weight Wo of the foodstuff 24 and utensil 26.

In block 72, the CPU provides computations on equations 1 and 2 to derive the first defrost period $T_1$ during which the frozen food 24 is to be initially heated at full microwave power, or 600 watts, and the second defrost period $T_2$ during which the foodstuff is to be subsequently heated at 180 watts to allow diffusion of thermal energies generated by the initial high power heating in the surface regions of the still frozen food. An initializing step follows (block 73) to set various flags and counters to initial states. Operation of start key 168 is detected (block 74) to energize switches 60 and 62 through drivers 61 and 63 (block 75) to start the initial defrost cycle. The frozen food 24 is heated at maximum energy level. Control proceeds to block 76 to set T1-flag to 1. This causes clock pulses to be counted in the CPU to check to see if a 1-second period has elapsed (block 77) to introduce a delay before control advances through block 78 to block 79 where the count $T_1$ is decremented by one. Count $T_1$ will decrease to zero if the frozen food is not heated excessively in proportion to its initial frozen state. A check step in block 80 determines if the period $T_1$ has expired to allow control to advance to step 82 to reset the T1-flag to zero when the frozen food is not heated excessively in a manner as referred to above. If $T_1$ is not expired, control advances to a check step 81 to examine the output of the humidity sensor 38 to detect if it has reached a first prescribed level $\Delta h_1$ by interrogating the sensor through terminal 181. If not, control returns to block 77 to repeat the blocks 77 to 81. If the frozen food is excessively heated during the initial defrost cycle $T_1$, control exits from block 81 to block 82 to reset the T1-flag to terminate this defrost cycle and set T2-flag to one in block 83 to initiate the defrost cycle $T_2$.

Control returns to block 77 to introduce a 1-second delay time and passes through block 78 to a check step in block 84 which decides if T2-flag has been set to 1 or zero. Control now exits to block 85 to supply a series of pulses through driver 63 to switch 62 to interrupt the microwave energy with an on-time duty ratio of 30%, so that the frozen food is heated at 180 watts. Control proceeds to block 86 to decrement the count $T_2$ by one. Block 87 follows to test if count $T_2$ has reached zero or not. Thus, block 85 is executed until control execute block 89 which disables the interrupt operation by having the microcomputer supply a continuous signal to switch 62 after resetting the T2-flag in block 88.

Control now passes through blocks 77, 78 and 84 to a cooking cycle subroutine which starts with a humidity-flag check step in block 90 followed by block 91 where a timer count $T_3$ is incremented by one. Control goes to block 92 to examine the output of humidity detector 38 to detect whether it has reached a threshold $\Delta h_2$ higher than $\Delta h_1$ of block 81. The threshold $\Delta h_2$ indicates that the cooked food is approaching the final stage. If the output of humidity detector 38 is lower than threshold $\Delta h_2$, control returns to block 77 and executes the block 91, thus repeatedly incrementing the count $T_3$. When threshold $\Delta h_2$ is detected in block 92, the most recent value of the incremented count $T_3$ is stored in memory and the humidity flag (H-flag) is set to one in block 93 to indicate the end of the cooking cycle $T_3$. Control proceeds to block 94 to provide computations on equation 4 to determine a count $T_4$ for the final cooking cycle using the time data $T_1$, $T_2$ and $T_3$.

With the H-flag being set, control passes through block 90 to block 95 to decrement the count $T_4$ by one and exits to block 96 to check if $T_4$ has reached zero or not. If not, control loops through blocks 77, 78, 84, 90 to block 95 to successively decrement the count $T_4$ until it reduces to zero. In block 97 that follows, the microcomputer removes the continuous signal from switches 60 and 62 to turn off the microwave energy.

Figure 8:
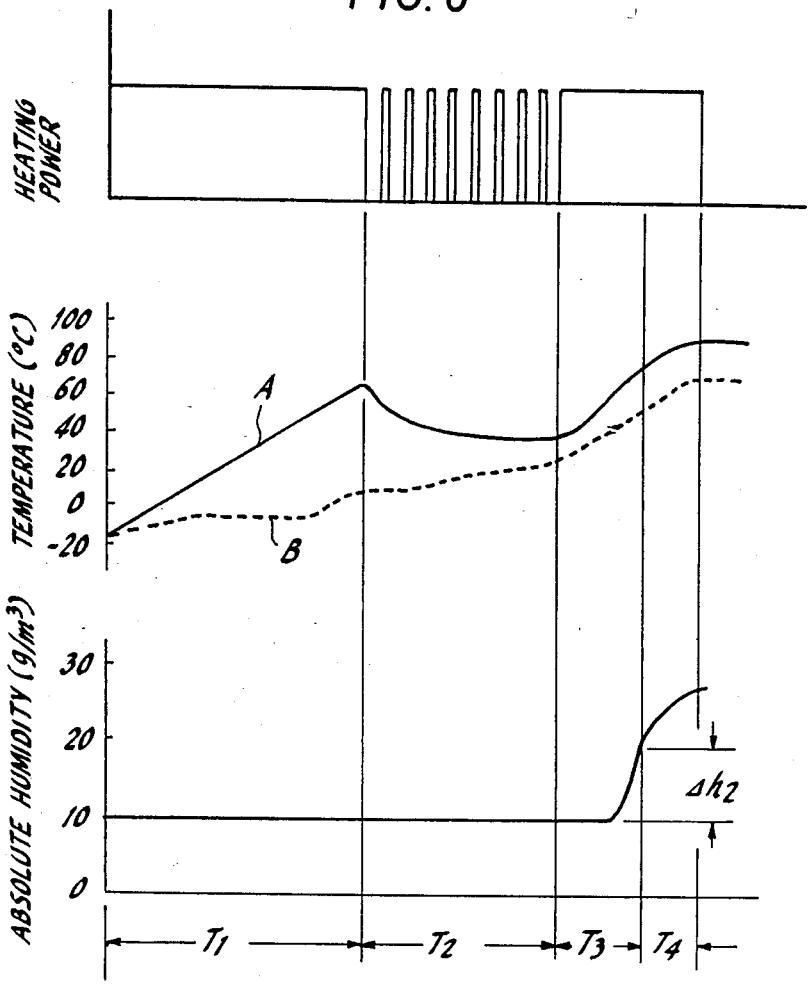
FIG. 8 is a timing diagram useful for describing the operation of the invention when a normally frozen food is heated.
Figure 9:
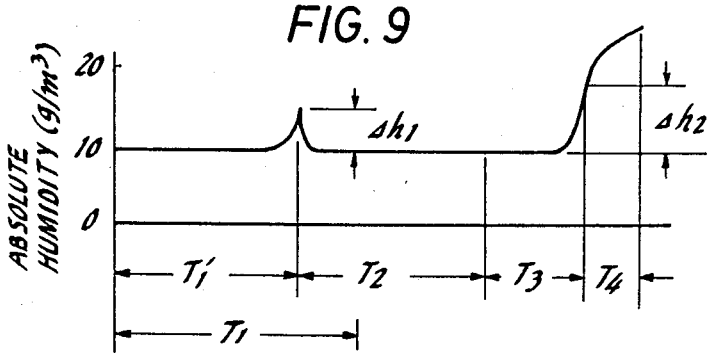
FIG. 9 is a timing diagram illustrating the absolute humidity of the heating chamber when partially thawed frozen food is heated.

The series of events mentioned above is illustrated in FIGS. 8 and 9. The heating pattern of FIG. 8 will be adopted if the frozen food has not excessively thawed before it is placed into the oven. Typically, during the initial defrost cycle the surface temperature of such frozen food rises linearly from the level of −20° C. to as high as 60° C. as indicated by a linear section of solid-line curve A. Whereas, the inner area of the food increases gradually at rates having an average value lower than the rate of increase on the surface area. During the second defrost cycle, the surface temperature of the frozen food decreases sharply and then assumes a steady value, while the inner temperature continuously increases to a point approaching the steady value of the surface temperature. Therefore, the frozen material is defrosted uniformly to a temperature which is appropriate for initiating cooking operation. During the subsequent cooking mode, the surface and inner temperatures rise at substantially equal rates, while the absolute humidity within the heating chamber 12 sharply increases as the cooking mode approaches the end of cooking cycle $T_3$. The heating pattern of FIG. 9 will be adopted if the frozen food has excessively thawed before it is placed into the oven. In such instance, the absolute humidity reaches the threshold $\Delta h_1$ at the end of a period $T_1'$ before the set period $T_1$ expires, and the second defrost cycle is initiated in response to the detection of the humidity value reaching the threshold $\Delta h_1$.

In an alternative embodiment, the microwave power of the second defrost cycle may be completely shut off during the second defrost cycle to allow diffusion of thermal energies into the inner area of the food. This is accomplished by replacing the blocks 85 and 89 with blocks 85*a* and 89*a* as shown in FIG. 7*a*.

Figure 10:
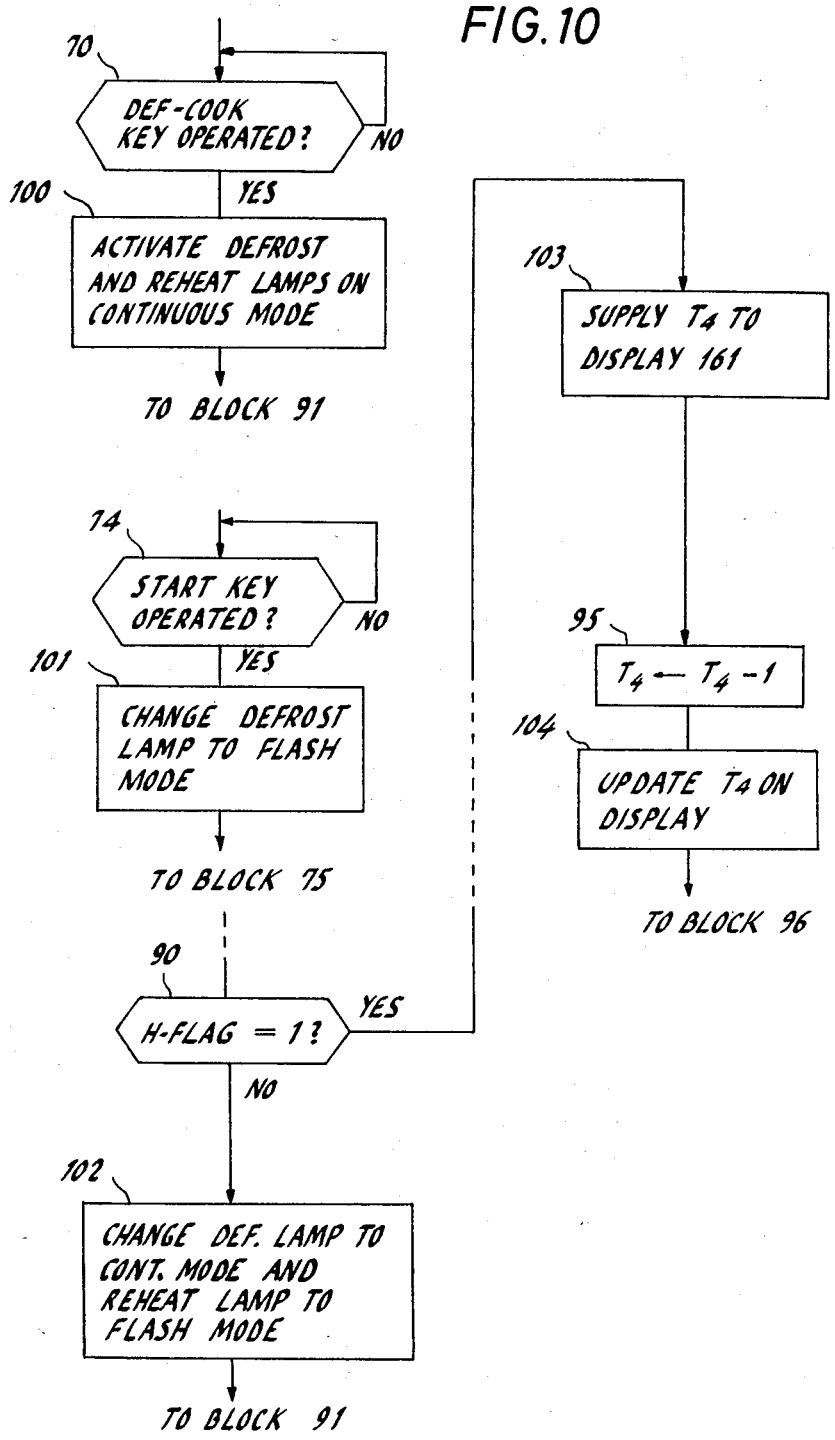
FIG. 10 is a flow diagram of the microcomputer for useful for giving visual indications of the progress of heating operations.
Figure 11:
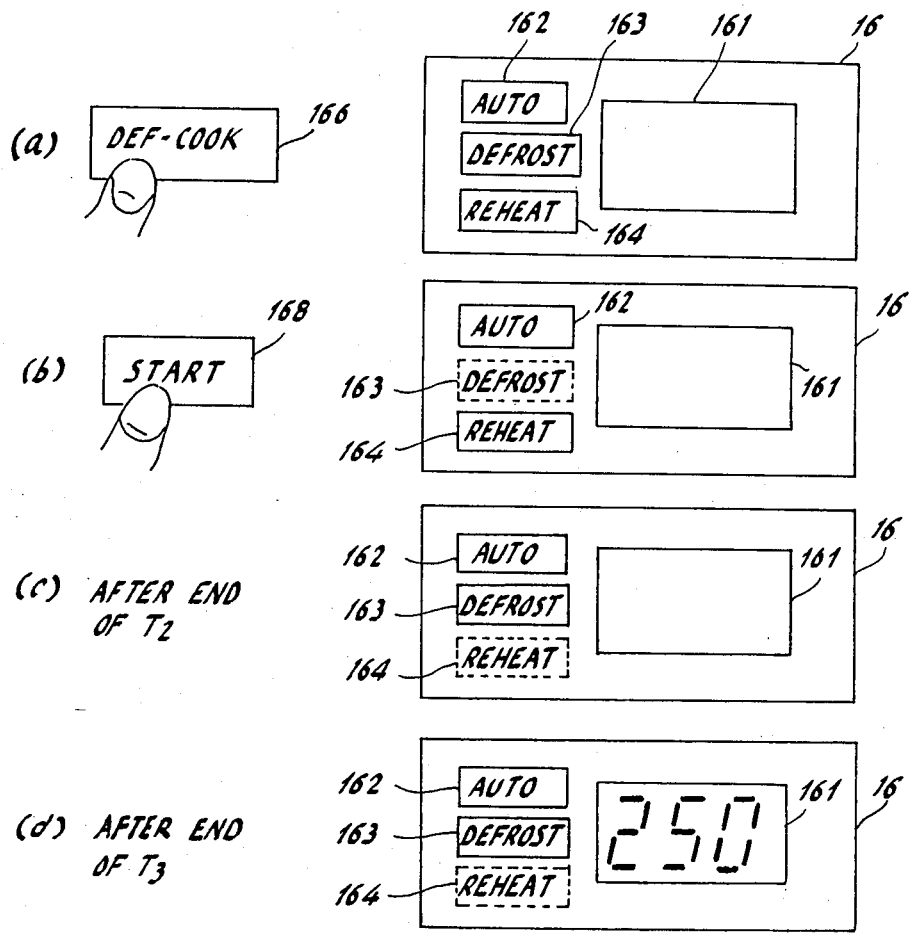
FIG. 11 is a schematic illustration of a series of visual indications during defrost-cooking modes.

Visual indication of the status of heating process is a convenient feature for users to allow them to see the progress of the heating process since the defrost-cooking mode of operation takes a relatively longer time. This is accomplished by modifying the flow diagram of FIG. 7 as illustrated in FIG. 10 in which the same numerals are used to indicate blocks having the same functions as the corresponding blocks of FIG. 7. After execution at block 70 after the defrost-cook mode key 166 is operated, control goes to block 100 to activate defrost lamp 163 and reheat lamp 164 on a continuous mode to indicate that the apparatus is ready for operation. These visual conditions are shown at a in FIG. 11 (in which the continuously lit lamps are indicated within solid-line rectangles). With the start key 168 being operated and checked in block 74, block 101 is executed to change the indication mode of defrost lamp 163 to a flash mode as indicated by a broken-line rectangle at b in FIG. 11. This condition indicates that the apparatus is working in the initial defrost cycle. When the second defrost cycle is over, control exits from block 90 to block 102 to change the indication of defrost lamp 163 to continuous mode and the indication of reheat lamp 164 to flash mode as shown at c in FIG. 11 to give a visual indication that the apparatus is in the process of second defrost cycle. When the apparatus enters the final stage of cooking mode, control exits from block 90 to block 103 to supply, time data $T_4$ obtained at block 94 to the liquid crystal display 161, as shown at d, FIG. 11, and the same visual indications as in the $T_1$ to $T_3$ cycles are given in this final stage. In block 104 that occurs subsequent to block 95, the displayed data $T_4$ is updated with the data decremented in block 95.

Figure 12:
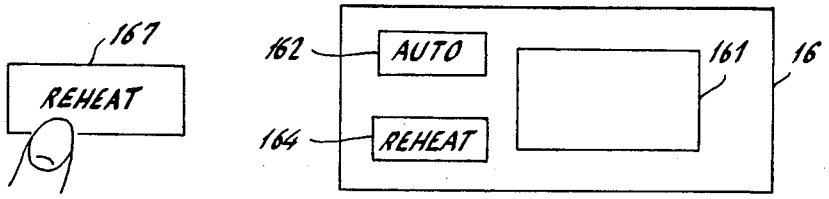
FIG. 12 is an illustration of visual indication for automatic reheat mode.

The continued defrost-cooking mode of operation as taught by the invention is particularly useful for cooking prepared frozen foods. The visual indication given by the reheat lamp is to imply that it is a prepared food that is being heated again. The "reheat" indication can be used in common with an automatic cook mode in which it is simply desired to warm a nonfrozen prepared food. In this mode, the reheat key 167 is operated to trigger the microcomputer to initiate a reheat routine which corresponds to a subroutine including blocks 90 to 97 with the data in block 94 replaced with equation 3. Automatic mode lamp 162 and reheat lamp 164 are continuously lit and defrost lamp extinguished (FIG. 12).

The present invention thus provides the following features.

(1) The succesive heating of frozed foods at high and low microwave energies eliminates localized hot and cold spots.

(2) The subsequent application of reduced energy or energy shutoff allows efficient diffusion of thermal energy from localized hot spot created by the application of higher energy with a resultant reduction in the total heating time.

(3) The uniformly defrosted foodstuff allows it to be heated in the subsequent cooking mode without damaging the natural quality of the food.

(4) The estimation of the true weight of the foodstuff from the total weight of the article placed in the oven by correlation eliminates the otherwise complicated procedure.

(5) The weight detector and humidity detector act in a complementary manner to each other to compensate for errors which might occur when a disproportionally large utensil is used or when the frozen food has been abnormally defrosted before being placed into the oven.

(6) The visual indication of succesive heating cycles by different modes of lighting conditions provides a means for keeping users constantly informed of the progress of the heating operations.

(7) Defrost and reheat visual indications for the defrost-cooking mode allows the reheat indication to be used in common with an automatic reheat mode.

What is claimed is:

1. A microwave oven comprising:

manually operated command entry means for the entry of a command to sequentially operate the oven in defrost and cooking modes;

a heating chamber having table means on which an article to be heated is placed, wherein said article may either comprise a foodstuff exclusively or a combination of a container and a foodstuff contained therein;

microwave energy generating means for radiating microwave energy into said chamber for heating said article;

weight detecting means coupled to said table means for detecting the weight of said article;

means for detecting a substance emitted by said foodstuff as a result of heating; and control means operable in response to the entry of said command for determining a first time period for said defrost mode as a function of the detected weight, causing said energy generating means to generate microwave energy of a lower level during said first time period, causing said energy generating means to switch to a higher energy level at the termination of said first time period, detecting when the emitted substance reaches a predetermined amount, detecting a second time period elapsed between the termination of said first time period and the detection of said emitted substance reaching the predetermined amount, and determining a third time period as a function of said second time period and allowing said energy generating means to maintain said higher energy level in the cooking mode until the termination of said third time period.

2. A microwave oven as claimed in claim 1, wherein said control means is further operable for dividing said first time period of the defrost mode into first and second consecutive defrost cycles, and for causing said energy generating means to generate microwave energy of a higher level during said first defrost cycle and microwave energy of a lower level during said second defrost cycle.

3. A microwave oven as claimed in claim 2, wherein said control means is arranged to cause said energy generating means to generate microwave energy in the form of burst pulses during said second defrost cycle, said pulses having a power level equal to the power level of the energy of said first defrost cycle, said burst pulses occurring with a duty ratio equal to the ratio of said lower energy level of the defrost mode to the higher energy level of said cooking mode.

4. A microwave oven as claimed in claim 2, wherein said control means is arranged to detect when the amount of the detected substance reaches a predetermined threshold during said first defrost cycle to cause said energy generating means to enter said second defrost cycle before said first defrost cycle terminates.

5. A microwave oven as claimed in claim 4, wherein said predetermined threshold detected in said defrost mode is lower than said predetermined amount of the substance detected after termination of said first time period.

6. A microwave oven as claimed in claim 1, wherein said control means is further operable for dividing said first time period of the defrost mode into first and second consecutive defrost cycles, and for causing said energy generating means to generate microwave energy during said first defrost cycle and to shut off the energy during said second defrost cycle.

7. A microwave oven as claimed in claim 6, wherein said control means is arranged to detect when the amount of detected substance reaches a predetermined threshold during said first defrost cycle to cause said energy generating means to enter said second defrost cycle before said first defrost cycle terminates.

8. A microwave oven as claimed in claim 7, wherein said predetermined threshold detected in said defrost mode is lower than said predetermined amount of the substance detected after termination of said first time period.

9. A microwave oven as claimed in claim 1, wherein said control means is further operable for setting the time period of said cooking mode is equal to $A(B \cdot t_1 + t_2)$, where:

$t_1$ = the first time period of said defrost mode, $t_2$ = the second time period elapsed between the termination of said first time period of the defrost mode and the detection of said emitted substance reaching the predetermined amount, A = a constant, and B = a ratio of the energy level of the microwave energy generated during the period $t_1$ to the energy level of the microwave energy generated during the period $t_2$.

10. A microwave oven as claimed in claim 1, further comprising:

second manually operated command entry means for the entry of a second command to operate said oven in a reheat mode;

a first visual indicator for indicating said defrost mode;

a second visual indicator for indicating said reheat mode;

said control means being responsive to the entry of the first-mentioned command for activating said first and second visual indicators in different lighting modes depending on whether said oven is operating on said defrost or cooking mode and responsive to the entry of said second command for activating said second visual indicator.

11. A microwave oven as claimed in claim 10, wherein said control means is responsive to the end of said second time period to estimate said third time period in which said cooking mode is to be continued as a function of the total of the first and second time periods, further comprising a third visual indicator for indicating said estimated third time period.

12. A microwave oven as claimed in claim 1, wherein said article includes a foodstuff and a utensil holding said foodstuff, said control means being responsive to said weight detecting means to multiply the detected weight by a preselected factor which represents a correlation between said detected weight and the weight of said foodstuff.

13. A microwave oven as claimed in claim 1, wherein said control means is further operable for compensating for errors in said first time period for said defrost mode due to differences between the detected weight of the article and the weight of said foodstuff alone by determining said third time period as a function of said second time period.

14. A microwave oven as claimed in claim 1, wherein said means for detecting a substance comprises humidity detecting means.

15. A method for operating a microwave oven which comprises a heating chamber having table means therein on which an article to be heated is placed, wherein said article may either comprise a foodstuff exclusively or a combination of a container and a foodstuff contained therein, microwave energy generating means for radiating microwave energy into said chamber for heating said article, weight detecting means coupled to said table means for detecting the weight of said article, and means for detecting a substance emitted by said foodstuff as a result of heating, the method comprising:

determining a first time period as a function of the detected weight;

causing said energy generating means to generate microwave energy of a lower level during said first time period and subsequently to generate microwave energy of a higher level;

during the subsequent generation of said higher level energy, detecting when the amount of the detected substance reaches a predetermined value;

detecting a second time period elapsed between the termination of said first time period and the detection of said substance reaching said predetermined value;

estimating a third time period for generation of said higher level energy as a function of said second time period;

deactivating said energy generating means at the end of said estimated third time period.

16. A microwave oven comprising:

manually operated command entry means for the entry of a command to sequentially operate the oven in defrost and cooking modes;

a heating chamber having table means on which an article to be heated is placed, wherein said article may either comprise a foodstuff exclusively or a combination of a container and a foodstuff contained therein;

microwave energy generating means for radiating microwave energy into said chamber for heating said article;

weight detecting means coupled to said table means for detecting the weight of said article;

means for detecting a substance emitted by said foodstuff as a result of heating;

means for determining a time period for said defrost mode as a function of the detected weight, and for causing said energy generating means to generate microwave energy of a lower level during said defrost mode time period, means for determining a cooking mode time period and for causing said energy generating means to generate microwave energy of a higher level during said cooking mode time period; and means for compensating for errors in said defrost mode time period due to differences between the detected weight of the article and the weight of said foodstuff along by determining said cooking mode time period as a function of a detected level of said emitted substance.

* * * * *